US008562364B2

(12) United States Patent
Lin et al.

(10) Patent No.: US 8,562,364 B2
(45) Date of Patent: Oct. 22, 2013

(54) CONNECTING PORT

(75) Inventors: Hsiu-Yen Lin, Taipei (TW); Chi-Kuang Chen, Taipei (TW)

(73) Assignee: Compal Electronics, Inc., Taipei (TW)

( * ) Notice: Subject to any disclaimer, the term of this patent is extended or adjusted under 35 U.S.C. 154(b) by 0 days.

(21) Appl. No.: 13/235,521

(22) Filed: Sep. 19, 2011

(65) Prior Publication Data

US 2012/0122325 A1 May 17, 2012

Related U.S. Application Data

(60) Provisional application No. 61/414,415, filed on Nov. 16, 2010.

(51) Int. Cl.
*H01R 13/64* (2006.01)

(52) U.S. Cl.
USPC ..... 439/246

(58) Field of Classification Search
USPC ..... 439/246, 252, 76.1, 63, 581, 607.4, 884
See application file for complete search history.

(56) References Cited

U.S. PATENT DOCUMENTS

| | | | | | |
|---|---|---|---|---|---|
| 3,366,920 | A | * | 1/1968 | Laudig et al. | 439/581 |
| 4,003,616 | A | * | 1/1977 | Springer | 439/23 |
| 4,008,941 | A | * | 2/1977 | Smith | 439/358 |
| 4,206,963 | A | * | 6/1980 | English et al. | 439/581 |
| 4,274,701 | A | * | 6/1981 | Bannert et al. | 439/748 |
| 4,605,269 | A | * | 8/1986 | Cohen et al. | 439/63 |
| 4,666,231 | A | * | 5/1987 | Sheesley et al. | 439/581 |
| 4,778,404 | A | * | 10/1988 | Pass | 439/387 |
| 4,846,711 | A | * | 7/1989 | Kobler et al. | 439/63 |
| 4,904,206 | A | * | 2/1990 | Laudig et al. | 439/578 |
| 4,906,212 | A | * | 3/1990 | Mixon, Jr. | 439/857 |
| 4,941,831 | A | * | 7/1990 | Tengler et al. | 439/63 |
| 5,011,415 | A | * | 4/1991 | Suzuki et al. | 439/63 |
| 5,046,952 | A | * | 9/1991 | Cohen et al. | 439/63 |
| 5,334,050 | A | * | 8/1994 | Andrews | 439/579 |
| 5,411,409 | A | * | 5/1995 | Gray et al. | 439/329 |
| 5,490,033 | A | * | 2/1996 | Cronin | 361/212 |
| 5,588,867 | A | * | 12/1996 | Thevenaz | 439/381 |
| 5,645,454 | A | * | 7/1997 | Kosmala | 439/675 |
| 5,662,481 | A | * | 9/1997 | Wright | 439/63 |
| 5,738,546 | A | * | 4/1998 | Burroughs et al. | 439/620.03 |
| 5,890,926 | A | * | 4/1999 | Pauza et al. | 439/445 |
| 5,904,579 | A | * | 5/1999 | McLean et al. | 439/63 |
| 6,390,825 | B1 | * | 5/2002 | Handley et al. | 439/63 |

(Continued)

FOREIGN PATENT DOCUMENTS

TW M275599 9/2005

OTHER PUBLICATIONS

"Office Action of Taiwan Counterpart Application", issued on Jul. 8, 2013, p. 1-p. 5, in which the listed reference was cited.

*Primary Examiner* — Amy Cohen Johnson
*Assistant Examiner* — Vladimir Imas
(74) *Attorney, Agent, or Firm* — Jianq Chyun IP Office

(57) ABSTRACT

A connecting port is provided, which includes a socket casing and a first connecting pin. The socket casing is disposed on a circuit board. The first connecting pin is made in one piece and includes a fixed end, a free end and a plurality of elastic sheets. The fixed end is fixed in the socket casing. Each of the elastic sheets is integrally connected between the fixed end and the free end.

12 Claims, 5 Drawing Sheets

(56) References Cited

U.S. PATENT DOCUMENTS

| | | | | |
|---|---|---|---|---|
| 6,663,397 | B1 * | 12/2003 | Lin et al. | 439/63 |
| 6,799,983 | B2 * | 10/2004 | Pavlovic et al. | 439/181 |
| 6,932,614 | B1 * | 8/2005 | Kan | 439/580 |
| 6,976,873 | B2 * | 12/2005 | Taguchi | 439/578 |
| 6,994,564 | B1 * | 2/2006 | Kan | 439/63 |
| 7,014,480 | B1 * | 3/2006 | Weidner et al. | 439/95 |
| 7,086,867 | B2 * | 8/2006 | Nakagawa et al. | 439/63 |
| 7,165,974 | B2 * | 1/2007 | Kooiman | 439/63 |
| 7,563,133 | B2 * | 7/2009 | Stein | 439/578 |
| 7,722,362 | B2 * | 5/2010 | Frake et al. | 439/76.1 |
| 7,896,655 | B1 * | 3/2011 | Blasick et al. | 439/63 |
| 7,927,108 | B2 * | 4/2011 | Gong et al. | 439/63 |
| 8,162,672 | B2 * | 4/2012 | Huang | 439/63 |
| 8,241,078 | B2 * | 8/2012 | Tsuji | 439/884 |
| 2004/0038586 | A1 * | 2/2004 | Hall et al. | 439/578 |
| 2004/0092165 | A1 * | 5/2004 | Holland | 439/607 |
| 2004/0203283 | A1 * | 10/2004 | Chen et al. | 439/578 |
| 2005/0245104 | A1 * | 11/2005 | Nakagawa et al. | 439/63 |

* cited by examiner

CONNECTING PORT

CROSS-REFERENCE TO RELATED APPLICATION

This application claims the priority benefit of U.S. provisional application Ser. No. 61/414,415, filed Nov. 16, 2010. The entirety of the above-mentioned patent application is hereby incorporated by reference herein and made a part of this specification.

BACKGROUND OF THE INVENTION

1. Field of the Invention

The invention generally relates to a connecting port, and more particularly, to a connecting port disposed on a circuit board.

2. Description of Related Art

Along with the progress of science and technology and the popularization of computer system, more and more modern people are used to process documents, browse Internet, play AV files or store data by using computer system, so that the computer system has become one of indispensable tools for the modern people at work or in lives. No matter a desktop computer or a notebook computer, it has circuit boards, on which various electronic components are disposed and in charge of different functions. In addition, there are connecting ports disposed on the circuit board for connecting computer peripheral equipments such as keyboard, mouse and flash drive or a power.

When a user swaps a connecting wire or a power wire of a peripheral equipment to/from a connection port of a circuit board, an excessive applied force or improper force-applying direction may cause the connecting pin in the connecting port to be deformed or get fractured.

SUMMARY OF THE INVENTION

Accordingly, the invention is directed to a connecting port able to reduce the probability of deformation or fracture with the connecting terminal thereof under a force.

The present invention provides a connecting port, which includes a socket casing and a first connecting pin. The socket casing is disposed on a circuit board. The first connecting pin is made in one piece and includes a fixed end, a free end and a plurality of elastic sheets. The fixed end is fixed in the socket casing. Each of the elastic sheets is integrally connected between the fixed end and the free end.

In an embodiment of the present invention, the above-mentioned first connecting pin is a hollow structure and has a plurality of slots between the fixed end and the free end for forming the elastic sheets between the fixed end and the free end.

In an embodiment of the present invention, the above-mentioned socket casing includes an insulation case, a first metal case and a second metal case. The insulation case is fixed at the circuit board. The first connecting pin is fixed at the insulation case. The first metal case is fixed at the insulation case, shields at least a part of the insulation case and has at least one ground pin. The ground pin is fixed at the circuit board. The second metal case is fixed at the insulation case and has a second connecting pin. The second connecting pin is fixed at the circuit board, and the first connecting pin and the second connecting pin are respectively a positive terminal and a negative terminal.

In an embodiment of the present invention, the above-mentioned insulation case includes a body and a fixing element. The body has at least one locking structure and is locked at the circuit board through the locking structure. The fixing element is embedded at the body. The first metal case has at least one locking groove. The fixing element has at least one locking hook and is locked at the locking groove through the locking hook. The first connecting pin is fixed at the fixing element and extends into the body.

In an embodiment of the present invention, the above-mentioned fixing element has a plurality of positioning slots, the fixed end has a plurality of positioning structures, and the positioning structures respectively extend into the positioning slots.

In an embodiment of the present invention, the above-mentioned body has a recess, the recess is positioned correspondingly to the locking groove, and the recess provides a space for the elastic deformation of the locking hook.

In an embodiment of the present invention, the above-mentioned insulation case has at least one positioning slot, the first metal case has at least one positioning elastic sheet and is locked at the positioning slot through the positioning elastic sheet.

In an embodiment of the present invention, the above-mentioned first metal case has at least one clamping elastic sheet, the clamping elastic sheet contacts the insulation case, and the insulation case is fixed by elastic force of the clamping elastic sheet.

In an embodiment of the present invention, the above-mentioned insulation case has at least one positioning slot, and the second metal case has at least one positioning elastic sheet and is locked at the positioning slot through the positioning elastic sheet.

In an embodiment of the present invention, the above-mentioned second metal case has a retaining portion and the retaining portion prevents the fixing element from moving away from the body.

In an embodiment of the present invention, a side of the insulation case has a supporting portion leaned against a surface of the circuit board.

In an embodiment of the present invention, a side of the first metal case has a supporting portion leaned against a surface of the circuit board.

In an embodiment of the present invention, the above-mentioned connecting port is a power connecting port.

Based on the description above, the connecting pin of the connecting port in the invention comprises a fixed end, a free end and a plurality of elastic sheets connected between the fixed end and the free end. When a user swaps a connecting wire or a power wire of a peripheral equipment to/from a connection port, the design of the invention can reduce the probability of deformation or fracture of the connecting pin under a force by means of the elastic deformation characteristic of the elastic sheets so as to advance the durability of the connecting port.

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
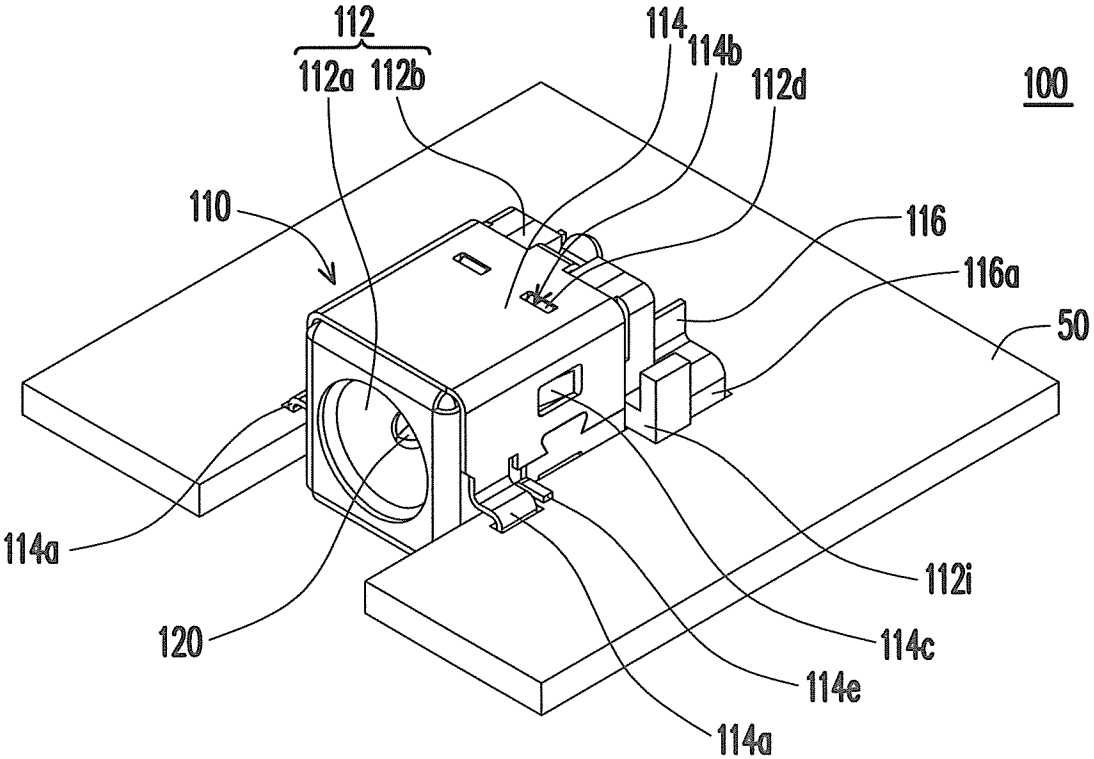
FIG. 1 is a three-dimensional view of a connecting port according to an embodiment of the invention.
Figure 2:
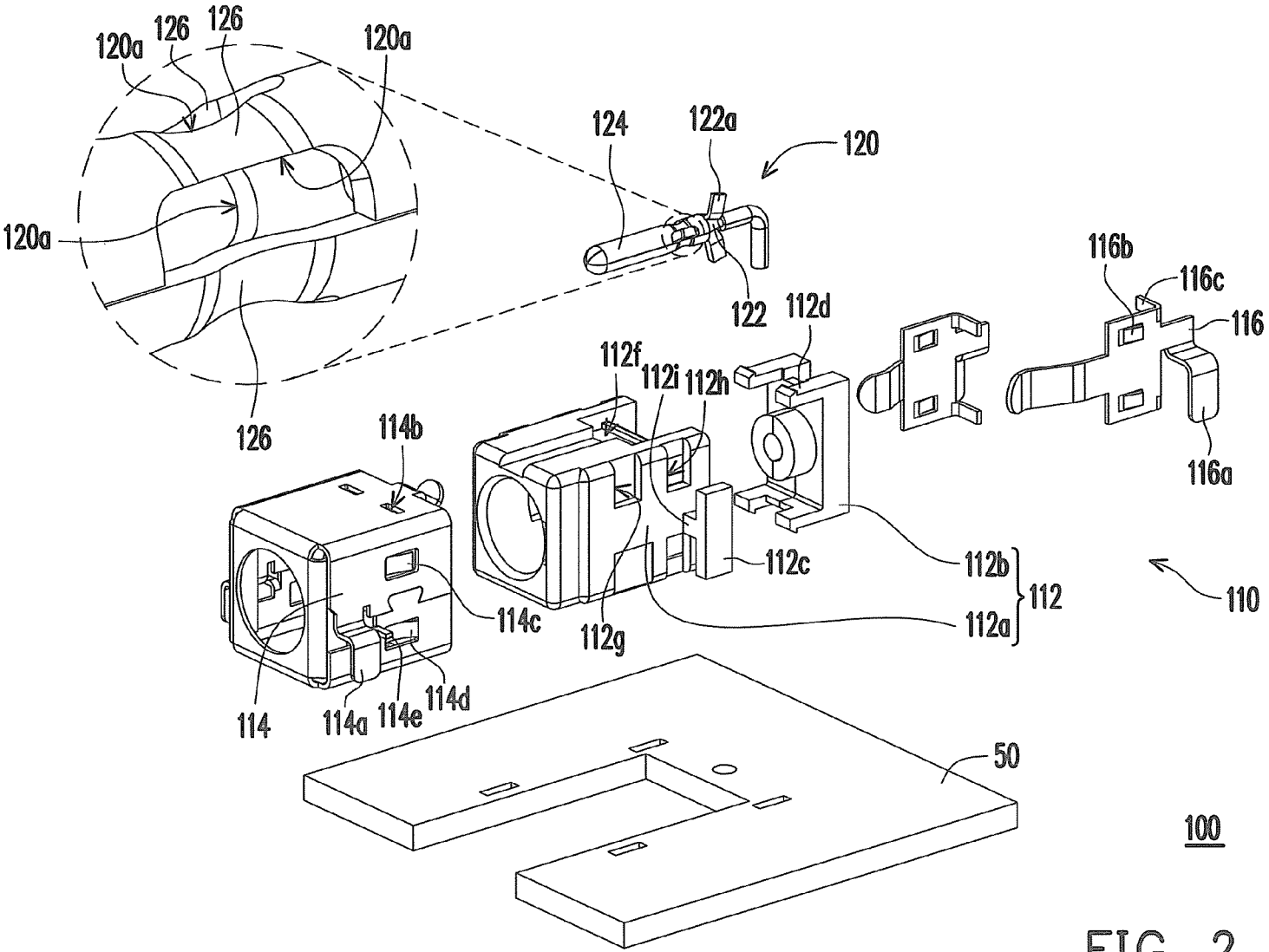
FIG. 2 is an exploded diagram of the connecting port of FIG. 1.

FIG. 1 is a three-dimensional view of a connecting port according to an embodiment of the invention and FIG. 2 is an exploded diagram of the connecting port of FIG. 1. Referring to FIGS. 1 and 2, a connecting port 100 of the embodiment includes a socket casing 110 and a first connecting pin 120. The socket casing 110 is disposed on a circuit board 50. The first connecting pin 120 includes a fixed end 122, a free end 124 and a plurality of elastic sheets 126. The fixed end 122 is fixed in the socket casing 110 and each of the elastic sheets 126 is integrally connected between the fixed end 122 and the free end 124. The first connecting pin 120 is made in one piece, wherein the fixed end 122, the free end 124 and the elastic sheets 126 are of the same material. With the above-mentioned layout, when a user swaps a power wire to/from the connection port 100, the design of the invention can reduce the probability of deformation or fracture of the first connecting pin 120 under a force by means of the elastic deformation characteristic of the elastic sheets 126 so as to advance the durability of the connecting port 100.

The circuit board 50 of the embodiment, for example, is installed in a desktop computer, a notebook computer or other electronic apparatuses, and the connecting port 100 is a power connecting port of the desktop computer, the notebook computer or other electronic apparatuses. In other embodiments, the connecting port 100 can be used to connect computer peripheral equipments such as keyboard, mouse and flash drive, which the invention is not limited to.

Referring to FIG. 2, in the embodiment, the first connecting pin 120 is a hollow structure and has a plurality of slots 120*a* between the fixed end 122 and the free end 124, such that the elastic sheets 126 are formed between the fixed end 122 and the free end 124. The above-mentioned slots 120*a* are formed, for example, by punching process.

Figure 3:
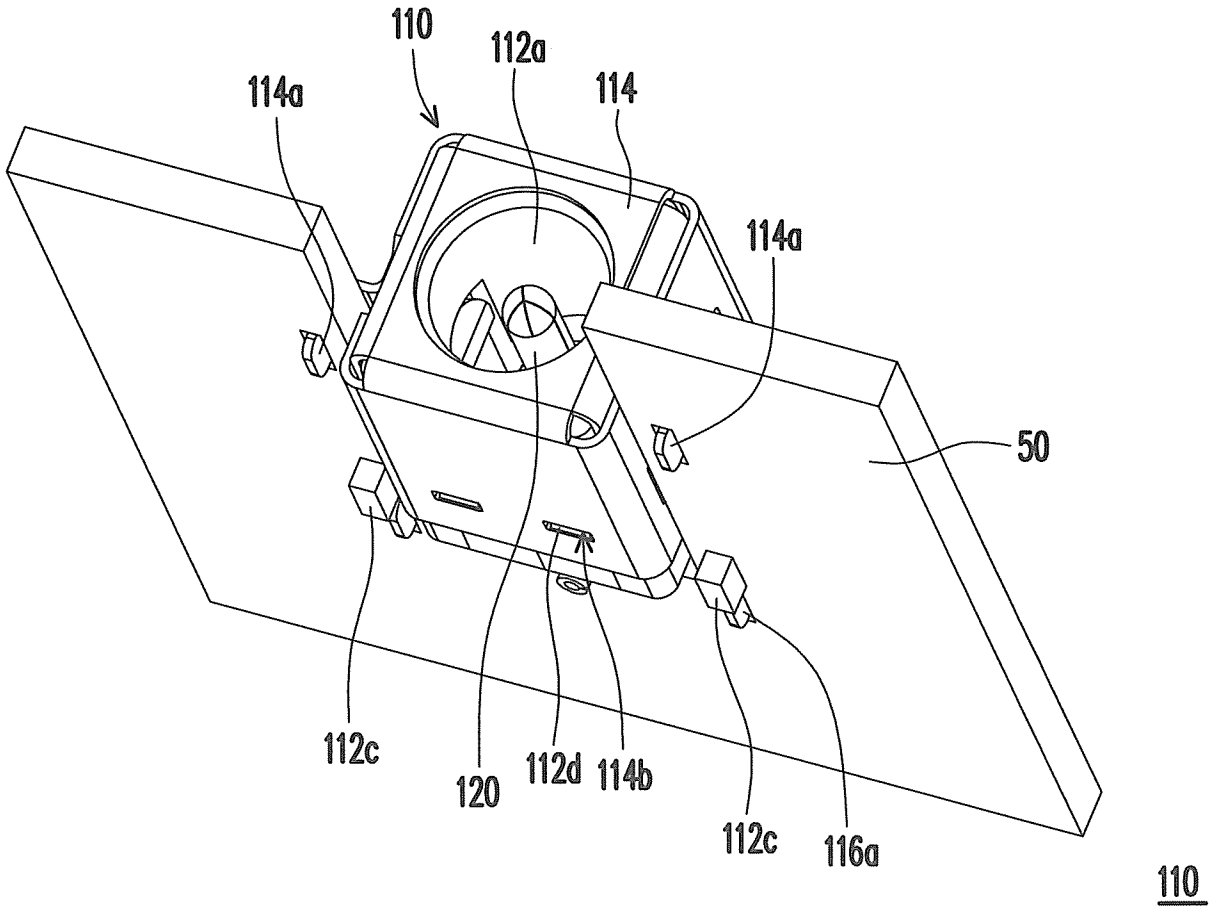
FIG. 3 is a three-dimensional view of the connecting port of FIG. 1 in another point of view.

FIG. 3 is a three-dimensional view of the connecting port of FIG. 1 from another point of view. Referring to FIGS. 1-3, the socket casing 110 of the embodiment includes an insulation case 112, a first metal case 114 and a second metal case 116. The insulation case 112 is fixed at the circuit board 50. The first connecting pin 120 is fixed at the insulation case 112. The first metal case 114 is fixed at the insulation case 112 and shields at least a part of the insulation case 112 and has at least one ground pin 114*a* (two are shown) so as to help shielding electromagnetic interference (EMI). The second metal case 116 is fixed at the insulation case 112 and has a second connecting pin 116*a*. Both the ground pins 114*a* and the second connecting pin 116*a* are fixed at the circuit board 50 to further enhance the integral structure strength and avoid displacement of components/parts caused by a user swapping a power to/from the connecting port 100. In the embodiment, the first connecting pin 120 and the second connecting pin 116*a* are respectively a positive terminal and a negative terminal.

In more details, the insulation case 112 in the embodiment includes a body 112*a* and a fixing element 112*b*. The body 112*a* has at least one locking structure 112*c* (two are shown) and is locked at the circuit board 50 through the locking structures 112*c*. The fixing element 112*b* is embedded at the body 112*a*, the first metal case 114 has at least one locking groove 114*b* (four are shown), and the fixing element 112*b* has at least one locking hook 112*d* (four are shown) and is locked at the locking grooves 114*b* through the locking hooks 112*d*. The first connecting pin 120 is fixed at the fixing element 112*b* and extends into the body 112*a*.

In the embodiment, the body 112*a* has a recess 112*f* and the recess 112*f* is positioned correspondingly to the locking grooves 114*b* of the first metal case 114 to provide the locking hooks 112*d* of the fixing element 112*b* with a space for elastic deformation, so that the locking hooks 112*d* can be locked into the locking grooves 114*b* through elastic deformation. In addition, the insulation case 112 has at least one positioning slot 112*g* and at least one positioning slot 112*h*, the first metal case 114 has at least one positioning elastic sheet 114*c* and is suitable to be locked at the positioning slot 112*g* through the positioning elastic sheet 114*c*, and the second metal case 116 has at least one positioning elastic sheet 116*b* and is suitable to be locked at the positioning slot 112*h* through the positioning elastic sheet 116*b*. The first metal case 114 further has at least one clamping elastic sheet 114*d*, and the clamping elastic sheet 114*d* is suitable to contact the insulation case 112 to make the insulation case 112 fixed by the elastic force of the clamping elastic sheet 114*d*.

Referring to FIGS. 1 and 2, in the embodiment, a side of the insulation case 112 has a supporting portion 112*i*, and a side of the first metal case 114 has another supporting portion 114*e*. Both the supporting portions 112*i* and 114*e* are suitable to be leant against a surface of the circuit board 50. In this way, prior to soldering the connecting port 100 at the circuit board 50, the connecting port 100 can be flatly and stably placed on the circuit board 50.

Figure 4:
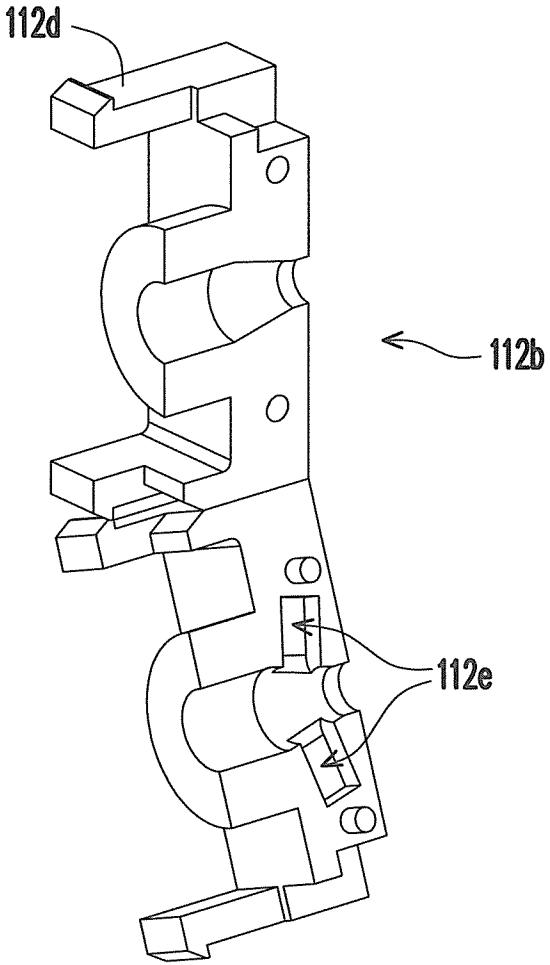
FIG. 4 is a schematic detail diagram of the fixing element in FIG. 1.

FIG. 4 is a schematic detail diagram of the fixing element in FIG. 1. Referring to FIGS. 2 and 4, in the embodiment, the fixing element 112*b* has a plurality of positioning slots 112*e*. The fixed end 122 of the first connecting pin 120 has a plurality of positioning structures 122*a*, which are suitable to respectively extend into the positioning slots 112*e* to fix the first connecting pin 120 at the fixing element 112*b*.

Figure 5:
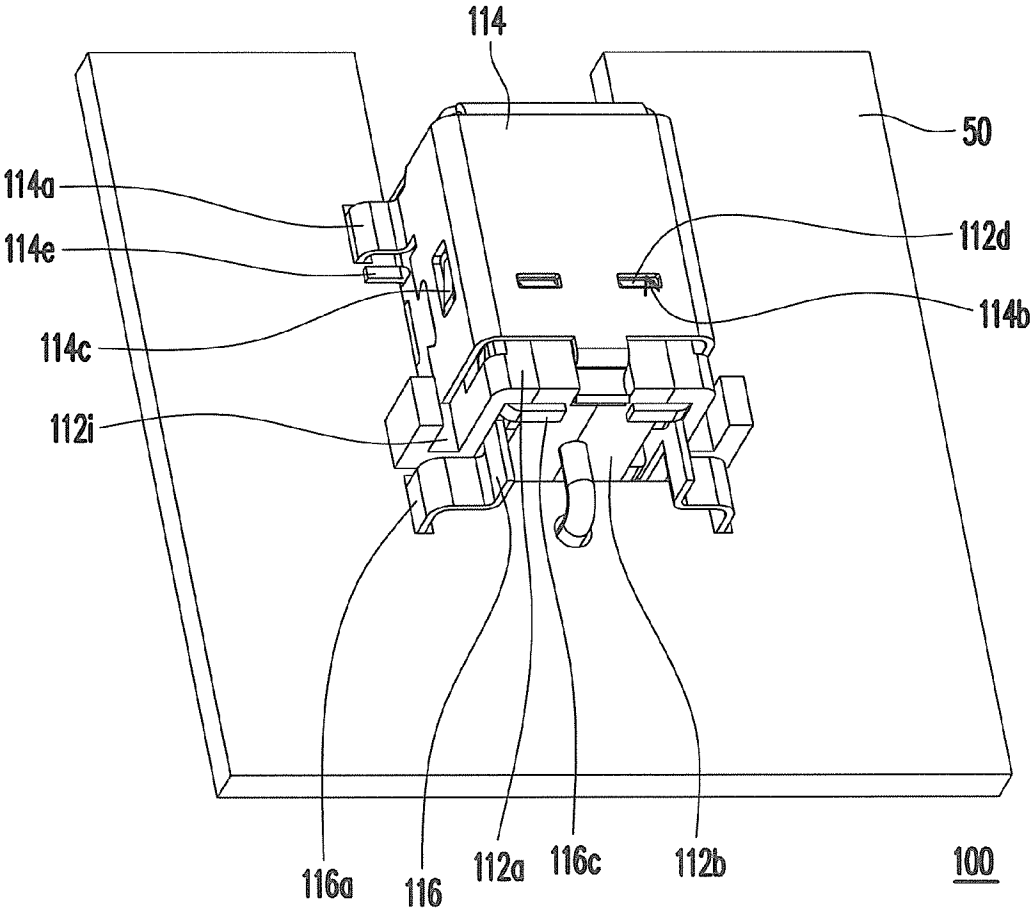
FIG. 5 is a three-dimensional view of the connecting port of FIG. 1 in further another point of view.

FIG. 5 is a three-dimensional view of the connecting port of FIG. 1 from yet another point of view. Referring to FIGS. 2 and 5, in the embodiment, the second metal case 116 has a retaining portion 116*c*, and the retaining portion 116*c* prevents the fixing element 112*b* from moving away from the body 112*a* so as to stably fix the fixing element 112*b* at the body 112*a*.

In summary, the connecting pin of the connecting port in the invention comprises a fixed end, a free end and a plurality of elastic sheets connected between the fixed end and the free end. When a user swaps a connecting wire or a power wire of a peripheral equipment to/from a connection port, the design of the invention can reduce the probability of deformation or fracture of the connecting pin under a force by means of the elastic deformation characteristic of the elastic sheets so as to advance the durability of the connecting port.

Reference will now be made in detail to the preferred embodiments of the invention, examples of which are illustrated in the accompanying drawings. It should be noted that the details of the structures hereinafter provided in the embodiments can be used in combination or replacement with each other, even be partially omitted according to the application practice. It will be apparent to those skilled in the art that various modifications and variations can be made to the structure of the invention without departing from the scope or spirit of the invention.

What is claimed is:

1. A connecting port, comprising:

a socket casing, disposed on a circuit board; and a first connecting pin made in one piece, comprising:

a fixed end, fixed in the socket casing;

a free end; and a plurality of elastic sheets; wherein each of the elastic sheets is integrally connected between the fixed end and the free end, wherein the socket casing comprises:

an insulation case, fixed at the circuit board, wherein the first connecting pin is fixed at the insulation case;

a first metal case, fixed at the insulation case, shielding at least a part of the insulation case and having at least one ground pin, wherein the ground pin is fixed at the circuit board; and a second metal case, fixed at the insulation case and having a second connecting pin, wherein the second connecting pin is fixed at the circuit board, and the first connecting pin and the second connecting pin are respectively a positive terminal and a negative terminal.

2. The connecting port as claimed in claim 1, wherein the first connecting pin is a hollow structure and has a plurality of slots between the fixed end and the free end for forming the elastic sheets between the fixed end and the free end.

3. The connecting port as claimed in claim 1, wherein the insulation case comprises:

a body, having at least one locking structure and locked at the circuit board through the locking structure; and a fixing element, embedded at the body, wherein the first metal case has at least one locking groove, the fixing element has at least one locking hook and is locked at the locking groove through the locking hook, and the first connecting pin is fixed at the fixing element and extends into the body.

4. The connecting port as claimed in claim 3, wherein the fixing element has a plurality of positioning slots, the fixed end has a plurality of positioning structures, and the positioning structures respectively extend into the positioning slots.

5. The connecting port as claimed in claim 3, wherein the body has a recess, the recess is positioned correspondingly to the locking groove, and the recess provides a space for the elastic deformation of the locking hook.

6. The connecting port as claimed in claim 1, wherein the insulation case has at least one positioning slot, the first metal case has at least one positioning elastic sheet and is locked at the positioning slot through the positioning elastic sheet.

7. The connecting port as claimed in claim 1, wherein the first metal case has at least one clamping elastic sheet, the clamping elastic sheet contacts the insulation case, and the insulation case is fixed by elastic force of the clamping elastic sheet.

8. The connecting port as claimed in claim 1, wherein the insulation case has at least one positioning slot, and the second metal case has at least one positioning elastic sheet and is locked at the positioning slot through the positioning elastic sheet.

9. The connecting port as claimed in claim 1, wherein the second metal case has a retaining portion and the retaining portion prevents the fixing element from moving away from the body.

10. The connecting port as claimed in claim 1, wherein a side of the insulation case has a supporting portion leaned against a surface of the circuit board.

11. The connecting port as claimed in claim 1, wherein a side of the first metal case has a supporting portion leaned against a surface of the circuit board.

12. The connecting port as claimed in claim 1, wherein the connecting port is a power connecting port.

* * * * *